US006409184B1

(12) United States Patent
Giannini

(10) Patent No.: US 6,409,184 B1
(45) Date of Patent: Jun. 25, 2002

(54) IN-LINE SKATE WITH SPRING CENTERING WHEELS

(76) Inventor: Ambrogio Giannini, 115 Van Horn St., West Springfield, MA (US) 01089

( * ) Notice: Subject to any disclaimer, the term of this patent is extended or adjusted under 35 U.S.C. 154(b) by 0 days.

(21) Appl. No.: 09/935,326

(22) Filed: Aug. 22, 2001

(51) Int. Cl.[7] ..... A63C 1/00

(52) U.S. Cl. ..... 280/11.233; 280/11.28; 280/87.042

(58) Field of Search ..... 280/11.221, 11.233, 280/11.25, 11.27, 11.28, 11.231, 268, 271, 87.041, 87.042; 16/35 D

(56) References Cited

U.S. PATENT DOCUMENTS 313,744 A * 3/1885 Lawless ..... 280/11.28
691,597 A * 1/1902 Christiansen ..... 280/271
940,783 A * 11/1909 Buckland ..... 280/271
2,482,961 A * 9/1949 Bishop ..... 280/271
3,287,023 A * 11/1966 Ware ..... 280/11.231
3,995,873 A * 12/1976 Pantzar ..... 280/87.042
4,138,127 A * 2/1979 Kimmell et al. ..... 280/11.28
4,294,456 A * 10/1981 Tuell et al. ..... 280/11.28
4,399,587 A * 8/1983 Penifaure ..... 16/35 D
4,838,564 A * 6/1989 Jarvis ..... 280/11.28
5,397,138 A * 3/1995 Mangelsdorf ..... 280/11.221
6,098,997 A * 8/2000 Cheng ..... 280/11.28

* cited by examiner

*Primary Examiner*—Michael Mar
(74) *Attorney, Agent, or Firm*—McCormick, Paulding & Huber LLP

(57) ABSTRACT

A skate device, e.g., a skate or skate board, includes a foot support device, e.g., a boot or a board, and a truck assembly for supporting the foot support device. The truck assembly has a first wheel housing mounted in pivotal relation to the foot support device. A first wheel has a first axle mounted to the first wheel housing for rotation about a first wheel axis. A first spring housing is mounted in fixed relation to the foot support device. A centering spring is mounted within the first spring housing and engages the first wheel housing to pivotally urge the first wheel toward a predetermined first center position.

19 Claims, 6 Drawing Sheets

IN-LINE SKATE WITH SPRING CENTERING WHEELS

FIELD OF THE INVENTION

The present invention relates to roller skates. More specifically, the present invention relates to an in-line skate having centering springs, which engage pivotally mounted wheel housings to align of the skate wheels along the in-line axis of the skate.

BACKGROUND OF THE INVENTION

Generally, prior art skates utilize a truck assembly attached to a skating boot to support and steer the skate. The truck assembly typically includes front and rear identical trucks attached to a supporting truck plate, which carries the sole of the boot. Each truck is usually a one piece casting of aluminum or other suitable material. The trucks have a generally horizontally extending pedestal portion and a generally vertically extending ball joint (or tongue) portion, both of which intersect at a bearing housing cast into the truck. An axle extends laterally through the bearing housing and carries a wheel on each end thereof. The upper end of the ball joint portion has a threaded ball joint, which engages a socket formed into the bottom of the truck plate. The pedestal portion supports a pedestal assembly, which extends upwardly to engage the truck plate in another socket formed into the truck plate.

The pedestal assembly typically includes one or more disk shaped shock absorbers of relatively hard but yeildable elastomeric material, e.g., hard rubber or urethane, which are separated by spacers. A king pin (or main stud) of the pedestal assembly extends through the center of the shock absorbers and spacers to thread into the truck plate socket. The arrangement and dimensioning of the pedestal assembly and ball joint permit limited rocking between the wheel axles and the skate boot as a skater shifts his or her weight during a turn or jump.

However, it is critical that the wheels snap back to their center position each time before a skater lands. Unfortunately, the elastomeric shock absorbers wear and set with repeated use. In time, the shock absorbers will permanently set such that the wheels will be out of alignment, i.e., out of their predetermined center position. This can be especially problematic for competitive skaters that rely on the ability of their skates to flex and realign with precision during each performance. Accordingly, prior art skates require relatively constant maintenance, and are difficult to adjust.

Additionally, the optimum amount of flex for each pair of skates varies from skater to skater depending on such factors as their level of skill, their weight and their style of skating. However, changing or adjusting the shock absorbers to vary the amount of flex is a difficult and time-consuming procedure. Moreover, the degree of flex will not remain constant as the elastomeric shock absorbers wear and set to one side.

Another problem associated with prior art skates is that the distance between the front and rear wheels are not adjustable for any given pair of skates. To a skater, the greater the distance between the front and rear wheels, the larger the turning radius and the greater the stability. Conversely, the smaller the distance, the smaller the turning radius and the less stable the skates. Again, the optimum distance depends on the skill level and style of the skater.

In the case of prior art in-line skates the wheels are rigidly aligned along an in-line axis of the skate which runs laterally through the center of the skate. However, prior art in-lines skates have little or no flexibility to compensate for weight shifts of a skater and to assist the skater during jumps or turns.

Accordingly, there is a need for an improved skate having a mechanism to more accurately and consistently flex and center its wheels after a jump or turn, and which is subject to less wear over time. Additionally, the amount of flex should be easily adjustable, as well as the distance between the front and rear wheels.

SUMMARY OF THE INVENTION

The present invention offers advantages and alternative over the prior art by providing a skate device, such as a skate or a skate board, having centering springs, which engage pivotally mounted wheel housings to align of the skate wheels along the in-line axis of the skate device. The wheels more accurately and reliably flex and snap back to their center positions than prior art skates. Additionally, the skate device has less of a tendency to wear in such a way that the wheels become set out of alignment. Moreover, the centering tension on the springs, as well as the in-line distance between the wheels, is easily adjustable.

These and other advantages are accomplished in an exemplary embodiment of the invention by providing a skate device, e.g., a skate or skate board. The skate device includes a foot support device, e.g., a boot or a board, and a truck assembly for supporting the foot support device. The truck assembly has a first wheel housing mounted in pivotal relation to the foot support device. A first wheel has a first axle mounted to the first wheel housing for rotation about a first wheel axis. A first spring housing is mounted in fixed relation to the foot support device. A centering spring is mounted within the first spring housing and engages the first wheel housing to pivotally urge the first wheel toward a predetermined first center position.

In an alternative embodiment of the invention, the truck assembly of the skate device has a truck plate attached to the foot support device. The first wheel housing is pivotally attached to the truck plate, and the first spring housing is rigidly attached to the truck plate.

In an alternative embodiment of the invention, the skate device includes a second wheel housing pivotally attached to the truck plate, opposing the first wheel housing. A second wheel has a second axle mounted to the second wheel housing for rotation about a second wheel axis. A second spring housing is attached to the truck plate, opposing the first spring housing. A second centering spring is mounted within the second spring housing and engages the second wheel housing to pivotally urge the second wheel toward a predetermined second center position. When the first and second wheels are in their respective centering positions they are substantially in line with each other and the first and second wheel axes are substantially parallel to each other.

In another alternative embodiment of the invention, each wheel housing of the skate device includes a plurality of laterally spaced mounting devices for adjusting the lateral distance between the first and second wheel axles along the in-line axis of the skate device.

In another alternative embodiment of the invention the truck housing of the skate device includes a first spring retainer plate removably mounted to the first spring housing to retain the first spring within an interior of the first spring housing.

DETAILED DESCRIPTION OF THE PREFERRED EMBODIMENTS

Figure 1:
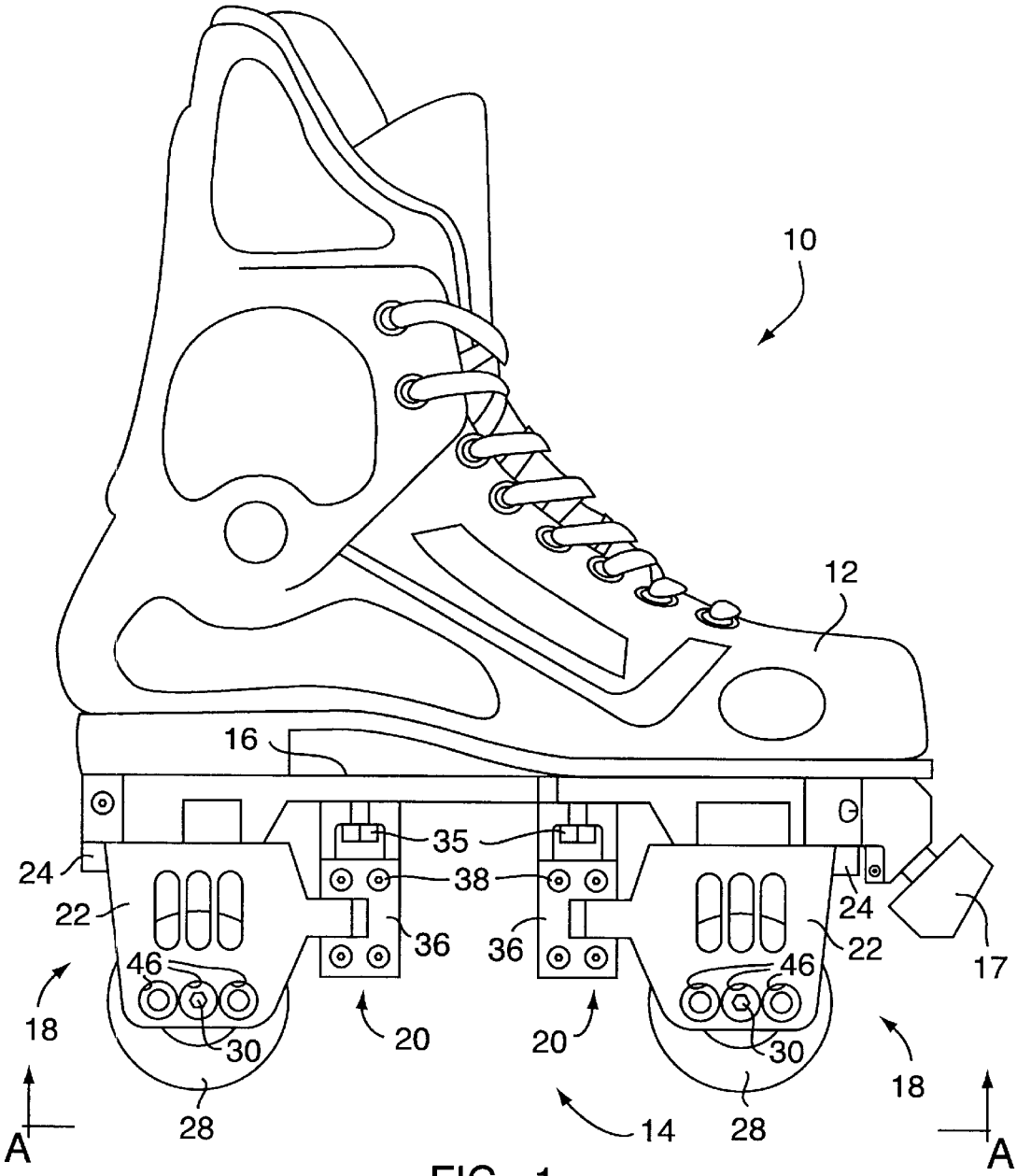
FIG. 1 is a side view of an exemplary embodiment of a skate in accordance with the present invention.
Figure 2:
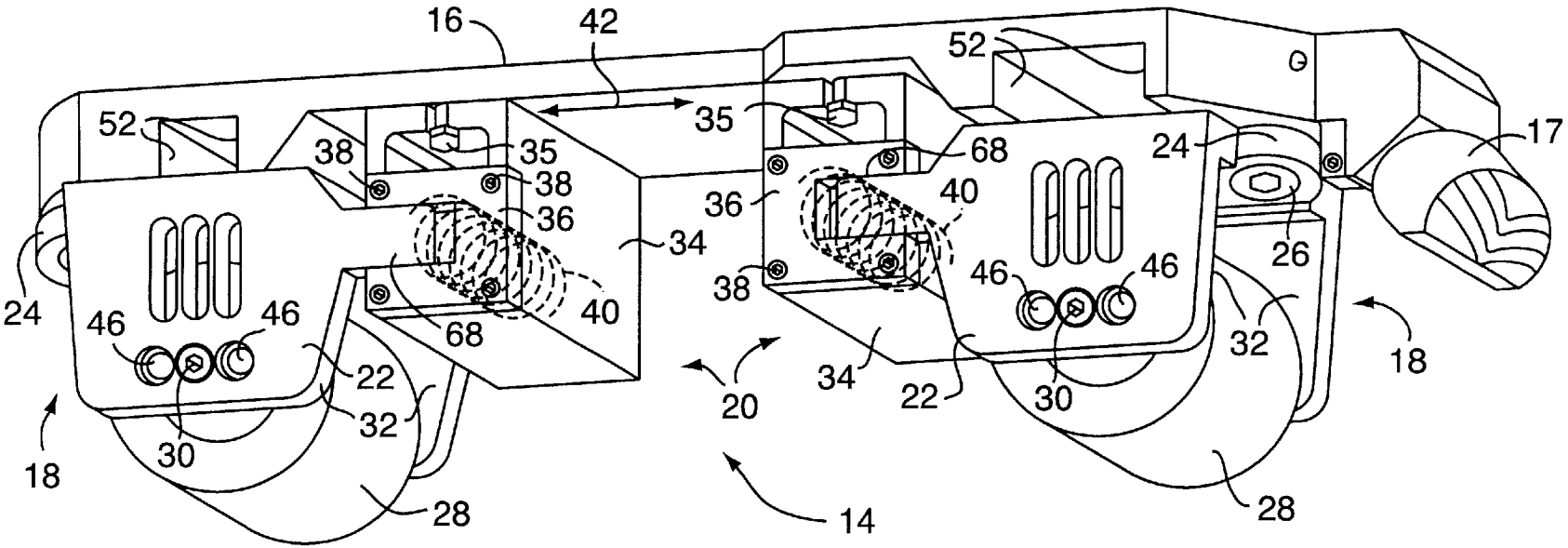
FIG. 2 is a perspective view of a truck assembly of the skate of FIG. 1.

Referring to FIGS. 1 and 2, an exemplary embodiment of an in-line skate in accordance with the present invention is shown generally a 10. The skate includes a skater's boot 12 removeably attached to a truck assembly 14 generally by fasteners such as a screw (not shown). Though this embodiment illustrates a skate having a boot attached to a truck assembly, other skating devices having other foot support devices are within the scope of this invention, e.g., the skating device could be a skate board having a board for a foot support device attached to the truck assembly.

The truck assembly 14 includes a truck plate 16 attached to the sole of the boot 12, an opposing pair of wheel housing assemblies 18 and an opposing pair of spring housing assemblies 20. An elastomeric toe stop 17 threadingly engages the toe end of the truck plate 16 to provide a break for a skater. Each wheel housing assembly 18 includes a generally U shaped wheel housing 22 having a rear mounting tab 24 for pivotal attachment to the truck plate 16 via shoulder bolt 26. A wheel 28 is journaled for rotation about a wheel axle 30, which extends through and is mounted to the opposing axial side walls 32 of the wheel housing 22.

Each spring housing assembly 20 includes a generally box shaped spring housing 34 rigidly mounted to the truck plate 16 with mounting bolts 35. The spring housing 34 includes a spring housing plate 36 removeably mounted to the spring housing 34 with plate mounting bolts 38. A centering spring 40 (best seen in FIG. 12 and represented in FIG. 2 by dotted lines) is removeably mounted within the spring housing 34, and retained therein with the spring housing plate 36.

An in-line axis 42 extends from heal to toe, i.e., laterally, along the truck plate 16 and substantially through the center thereof. Each wheel housing 22 engages its associated centering spring 40, which pivotally urges the wheels 28 toward a predetermined center position 44 (seen in FIG. 13). The center positions 44 are such that the wheels 28 are substantially aligned along the in-line axis 42. That is, the in-line axis passes substantially through the center of each axle 30, and each wheel axle 30 extends substantially perpendicular to the in-line axis 42 when the wheels 28 are in their predetermined center position 44. In distinct contrast to prior art skates, the pivotal action of the wheel housing assemblies 18 in association with the centering springs 40 allows for accurate and consistent steerage of the front and rear wheels 28 through body movement.

The wheel housing 22 also includes a plurality of laterally spaced axle mounting holes 46, which are disposed on the axially opposing side walls 32 of the wheel housing 22. The mounting holes are sized to receive the wheel axles 30 therethrough. The mounting holes 46 provide adjustment to the lateral distance between the pair of wheel axles 30 along the in-line axis 42 of the skate 10. Making the lateral distance between the wheels 28 adjustable enables the skate 10 to be adjusted to suit different skater's abilities. The closer the wheels 28 are positioned, the more maneuverable the skates 10.

Figure 3:
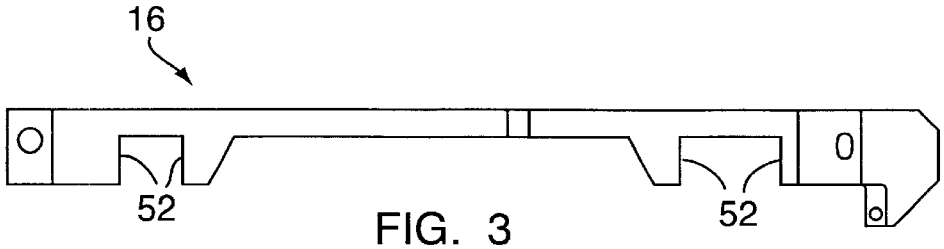
FIG. 3 is a side view of a truck plate of the skate of FIG. 1.
Figure 4:
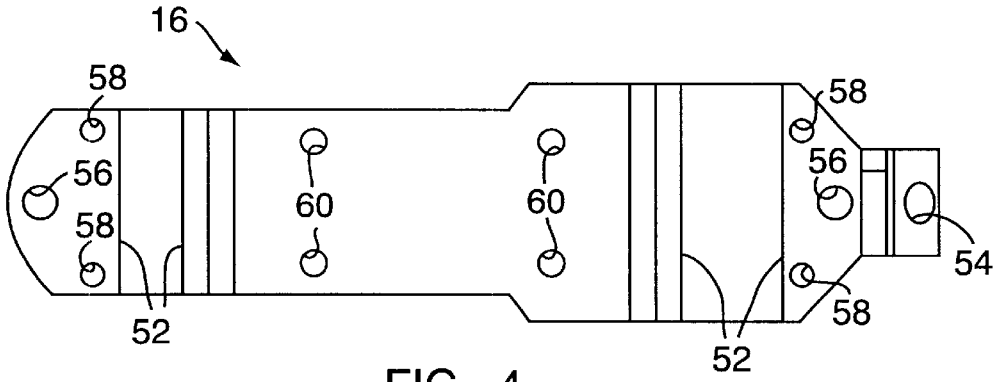
FIG. 4 is a bottom view of the truck plate of FIG. 3.
Figure 5:
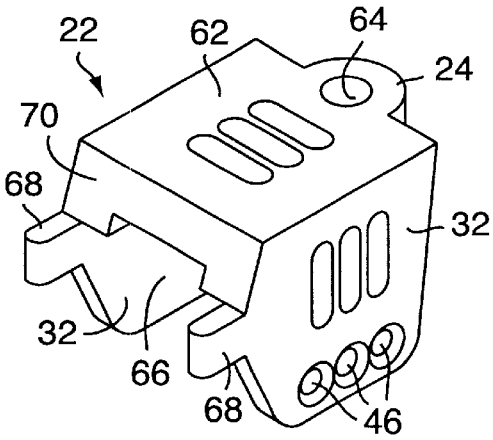
FIG. 5 is a perspective view of a wheel housing of the skate of FIG. 1.
Figure 6:
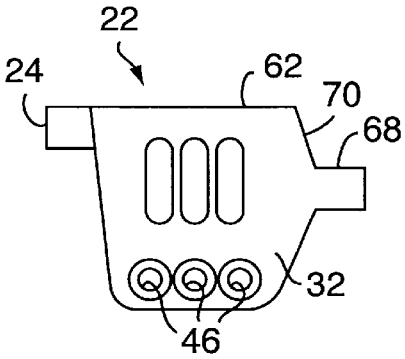
FIG. 6 is a side view of the wheel housing of FIG. 5.
Figure 7:
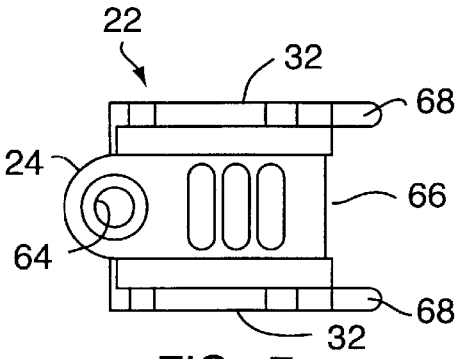
FIG. 7 is a bottom view of the wheel housing of FIG. 5.
Figure 8:
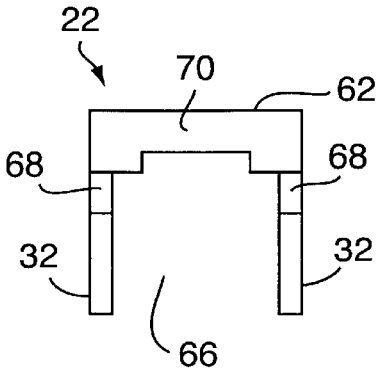
FIG. 8 is a front view of the wheel housing of FIG. 5.

Referring to FIGS. 3 and 4, the truck plate 16 is composed substantially of aluminum and has a generally elongated shape. The front or toe portion is wider than the rear or heal portion to accommodate the shape of the sole of the boot 12.

The truck plate 16 includes a plurality of stepped sections 52 to space and support the wheel housing assemblies 18 and the spring housing assemblies 20. A toe stop mounting hole 54 is sized to threadingly receive the toe stop 17. A pair of pivotal mounting holes 56 engages the shoulder bolts 26 which pivotally mount the wheel housing 22 to the truck plate 16. Boot mounting holes 58 are used to mount the boot 12 to the truck plate 16. Spring housing mounting holes 60 are sized to receive the mounting bolts 35 which attach the spring housing assemblies 20 to the truck plate 16.

Referring to FIGS. 5, 6, 7 and 8, the wheel housings 22 have a generally U shaped cross section (best seen in FIG. 8) and includes a top section 62 with the outwardly extending mounting tab 24 for pivotally mounting to the truck plate 16. The mounting tab includes mounting hole 64 sized to receive shoulder bolt 26 therethrough. When mounted to the truck plate 16, the axially opposing side walls 32 extend downwardly from axial ends of the top section 62 to define a wheel well 66 sized to receive the wheel 28 therein.

Three equally spaced axle mounting holes 46 are equally spaced along the bottom portion of each side wall 32 to provide adjustment to the lateral distance between the axles 30 of the in-line wheels 28, thereby making the skates 10 adjustable to suit different skater's abilities. That is, the closer the wheels 28 are adjusted, the more maneuverable the skates 10 and the less stable the skates 10. The farther apart the wheels 28, the less maneuverable the skates 10 but the more stable the skates 10. Therefore, the more advanced skaters would often want to adjust the wheels 28 closer to be able to perform tighter turns. Though equally spaced mounting holes 46 are illustrated in this embodiment, one skilled in the art would recognize that other laterally spaced mounting devices can be used to provide adjustment of the lateral distance between the axles 30. For example, slots having equally spaced locating notches may also be used.

A pair of spring engagement arms 68 project inwardly from center facing edges 70 of the side walls 32. When the wheel housing 22 is mounted to the truck plate 16, the arms 68 straddle the centering spring 40 (best seen in FIG. 13).

Figure 9:
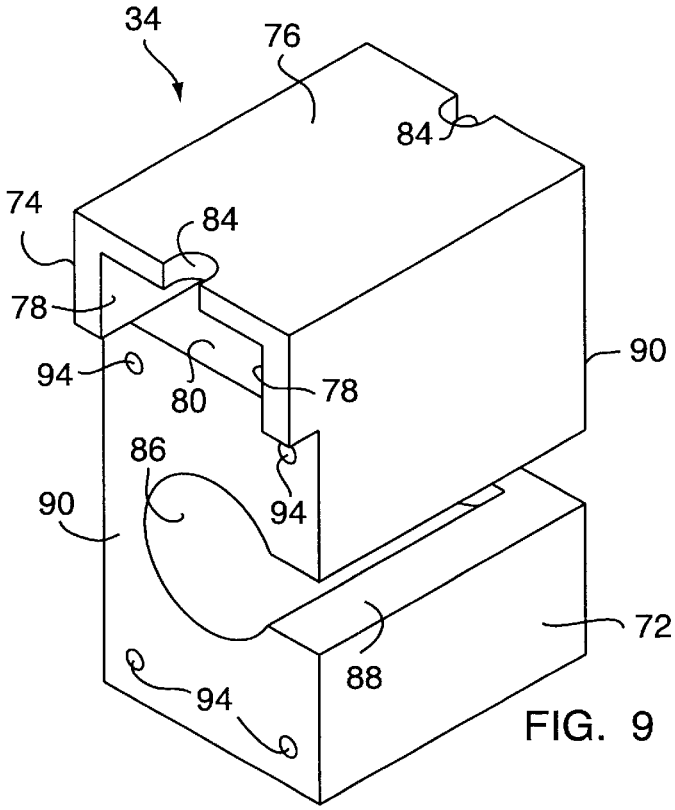
FIG. 9 is perspective view of a spring housing of the skate of FIG. 1 with its spring housing plate removed.
Figure 10:
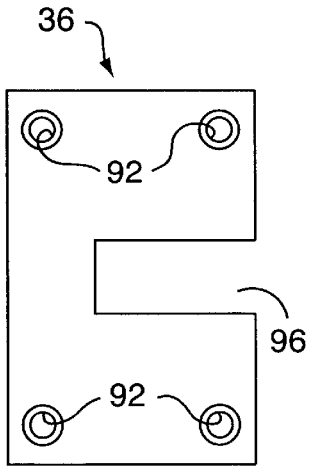
FIG. 10 is a side view of the spring housing plate associated with the spring housing of FIG. 9.
Figure 11:
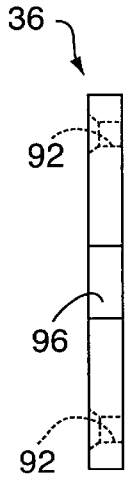
FIG. 11 is a front view of the spring housing plate of FIG. 10.

Referring to FIGS. 9, 10 and 11, the spring housing 34 has a box shaped lower portion 72 and an upper mounting portion 74. The upper mounting portion 74 has a cross section that is generally in the shape of an inverted U, wherein the top of the U is a top mounting wall 76 and the legs of the U are a pair of side walls 78 integrally connected to the top 80 of the lower portion 72. The top mounting wall 76 and side walls 78 define a mounting cavity having a generally rectangular cross section and sized to receive the heads of mounting bolts 35. The top mounting wall 76 also includes a pair of axially opposing mounting slots 84 sized to receive the threaded shanks of the mounting bolts 35 therein.

The lower portion 72 of spring housing 34 has a generally C shaped cross section, which defines a spring cavity 86 and an arm clearance slot 88. The spring cavity 86 has the necessary dimensions to slidably receive the centering spring therein. The arm clearance slot 88 is sized to allow the spring engagement arms 68 to straddle the centering spring 40 without interference.

The spring housing plate 36 of the spring housing 34 fits against the indented wall section 90 and is fastened thereto with plate mounting bolts 38. The plate mounting bolts 38 slide through chamfered through holes 92 of the spring housing plate 36 to threadingly engage mounting holes 94 located on the indented wall section 90 to effectively capture the centering spring 40 in the spring cavity 86. The spring housing plate 36 also includes an arm clearance slot 96 sized to mate with the arm clearance slot 88 in order to allow pivotal movement of the wheel housing 22 when the spring engagement arms 68 straddle the centering spring 40.

Figure 12:
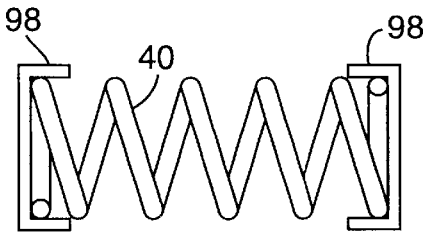
FIG. 12 is a perspective view of a spring and end caps which mount into the spring housing of FIG. 10.

Referring to FIG. 12, the centering spring 40 has a pair of end caps 98 which are sized to fit over the ends of the centering spring 40. The end caps 98 provide for more positive engagement of the spring engagement arms with the centering spring 40 when the wheel housing 22 is pivoting. The wheels 28 are therefore spring loaded to assure a return to a predetermined center position, i.e., neutral, for straight line skating. Also the springs 40 may be changed to allow for different spring tensions, therefore suiting the different abilities of different skaters.

Though this embodiment illustrates a single spring 40 being straddled by a pair of arms 68, other configurations are within the scope of this invention. For example, a pair of springs may be mounted in the spring housing and used to straddle a single engagement arm of the wheel housing.

Figure 13:
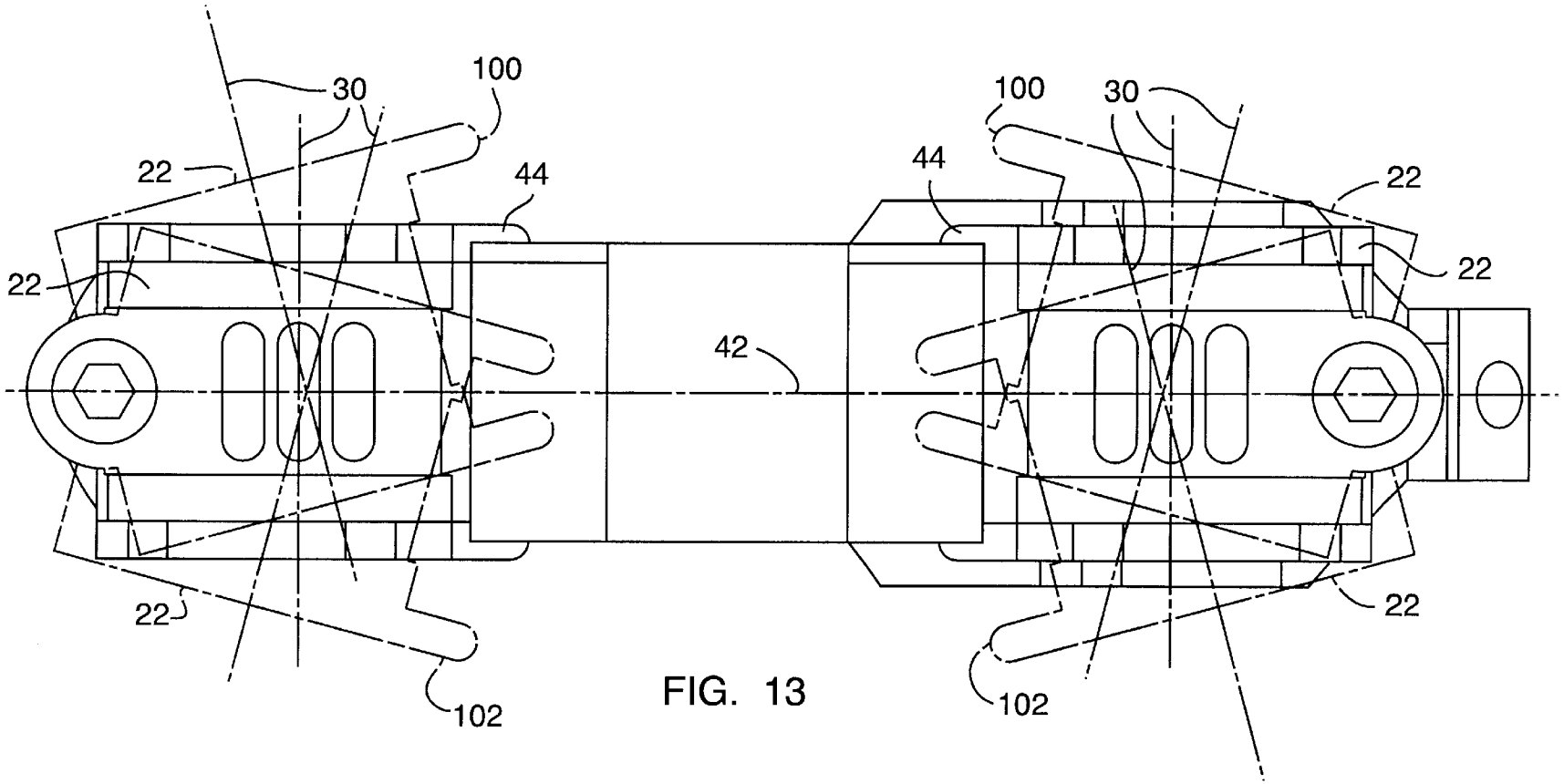
FIG. 13 is a top view of the truck assembly of FIG. 1 taken along the line A—A, showing the wheel housings in their center positions, left most pivot positions and right most pivot positions.

Referring to FIG. 13, the pivotal action of the wheel housing 22 is shown. In the neutral, or center position 44 of the wheel housing 22, the wheels 28 are substantially aligned with the in-line axis 42. That is wheel axles 30 are substantially perpendicular to the in-line axis 42, and the in-line axis 42 passes substantially through the center of each wheel axle 30. In the extreme opposing pivot positions 100 and 102 respectively, the angular movement of the wheels 28 are approximately fifteen degrees on each side of the in-line axis 42.

Figure 14:
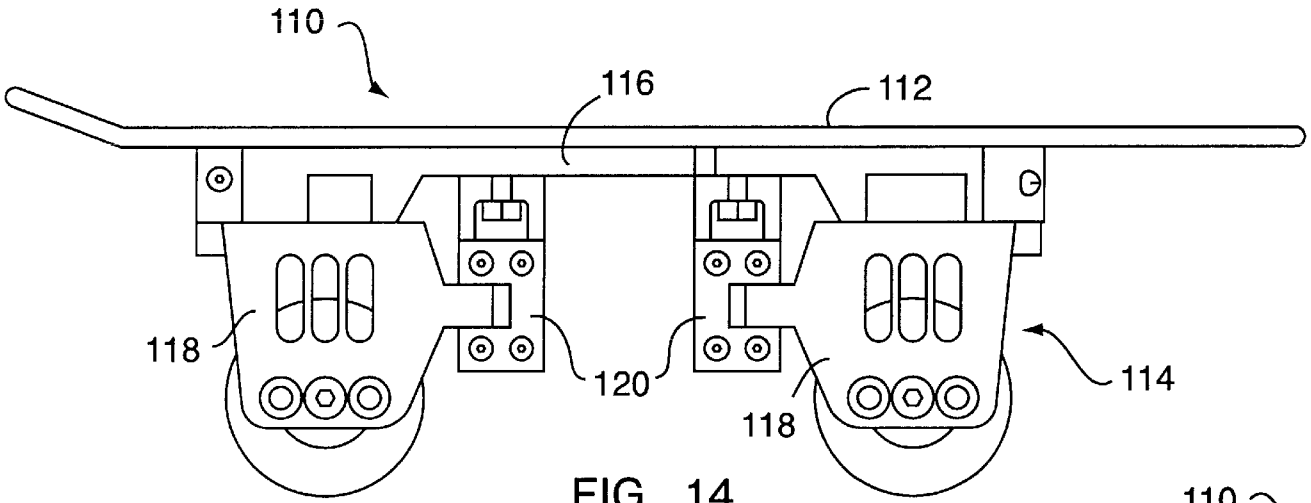
FIG. 14 is a side view of an exemplary embodiment of a skate board in accordance with the present invention.
Figure 15:
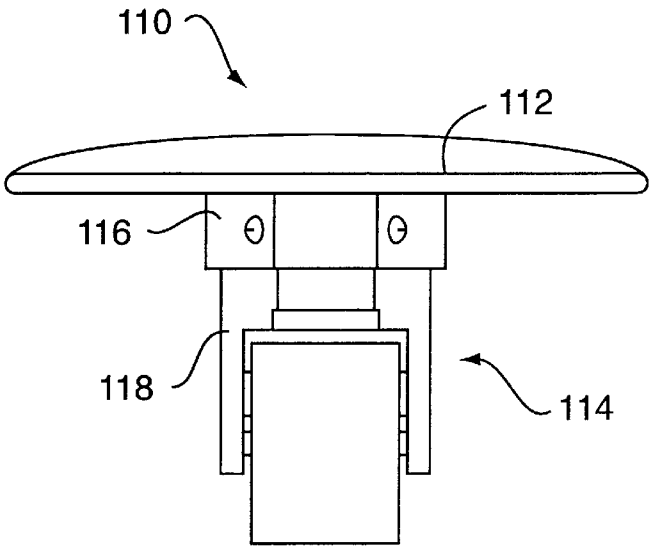
FIG. 15 is a front view of the skate board of FIG. 14.

Referring to FIGS. 14 and 15, an alternative embodiment of a skating device in accordance with the present invention is shown generally at 110. In this embodiment, the skating device illustrated is a skate board 110 wherein the foot support device is a board 112 rather than a boot. The in line skate board 110 includes a truck assembly 114 fastened to the board 112 by fasteners such as screws (not shown).

The truck assembly 114 includes a truck plate 116 attached to the under side of board 112, an opposing pair of wheel housing assemblies 118 and an opposing pair of spring housing assemblies 120. The truck assemble 114 functions in essentially the same manner as the truck assemble 14 described in detail hereinbefore. However, unlike the embodiment of the skate, one skilled in the art would see that the truck assembly for the skate board could also function without a truck plate 116. That is the wheel housing assemblies and the spring housing assemblies could be mounted directly to the board 112.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A skate device comprising:

a foot support device; and a truck assembly for supporting the foot support device, the truck assembly having:

a first spring housing fixedly attached to the foot support device, the first spring housing having a spring cavity, and a spring housing plate removably mounted to one side of the first spring housing, the spring housing having a clearance slot extending laterally therethrough including the spring housing plate, a centering spring removably mounted within the spring cavity and retained therein with the spring housing plate, a first wheel housing pivotally mounted to the foot support device and having a pair of arms extending longitudinally through the clearance slot of the first spring housing to straddle the centering spring therebetween, and a first wheel having a first axle mounted to the first wheel housing for rotation about a first wheel axis;

wherein the centering spring pivotally urges the first wheel housing, with the first wheel rotatably mounted therein, toward a predetermined first center position for rotational movement in a longitudinal direction of the skate device; and wherein the centering spring may be changed by removing the first spring housing plate from the first spring housing and pivoting the first wheel housing to expose the centering spring.

2. The skate device of claim 1 wherein the foot support device is a boot and the skate device is a skate.

3. The skate device of claim 1 wherein the foot support device is a board and the skate device is a skate board.

4. The skate device of claim 1 wherein the truck assembly comprises:

a truck plate attached to the foot support device;

the first wheel housing pivotally attached to the truck plate; and the first spring housing rigidly attached to the truck plate.

5. The skate device of claim 1 wherein the skate device is an in-line skate device having an in-line axis and the truck assembly comprises:

a second wheel housing pivotally mounted to the foot support device, wherein the first and second wheel housings are mounted along the in-line axis at opposing end portions of the truck assembly;

a second wheel having a second axle mounted to the second wheel housing for rotation about a second wheel axis;

a second spring housing fixedly attached to the foot support device, the second spring housing having a second spring cavity and a second clearance slot extending laterally therethrough; and a second centering spring mounted within the second spring cavity, the second centering spring being straddle between a second pair of arms extending longitudinally from the second wheel housing through the second clearance slot to pivotally urge the second wheel housing, with the second wheel rotationally mounted therein, toward a predetermined second center position;

wherein the first and second center positions having a relation such that the first and second wheels are substantially aligned along the in-line axis.

6. The skate device of claim 5 wherein each wheel housing includes a plurality of longitudinally spaced mounting devices for adjusting the longitudinal distance between the first and second wheel axles along the in-line axis of the skate.

7. The skate device of claim 6 wherein the mounting devices include a plurality of longitudinally spaced pairs of mounting holes disposed on axially opposing sides of each wheel housing which are sized to receive each wheel axle therethrough.

8. The skate device of claim 1 wherein the spring housing is sized to receive one of a plurality of centering springs, each centering spring having a different spring tension.

9. A skate comprising:

a boot; and a truck assembly for supporting the boot, the truck assembly having; a truck plate attached to the sole of the boot, a first spring housing fixedly attached to the truck plate, the first spring housing having a spring cavity, and a spring housing plate removably mounted to one side of the first spring housing, the spring housing having a clearance slot extending laterally therethrough including the spring housing plate, a centering spring removably mounted within the spring cavity and retained therein with the spring housing plate, a first wheel housing pivotally mounted to the truck plate and having a pair of arms extending longitudinally through the clearance slot of the first spring housing to straddle the centering spring therebetween, and a first wheel having a first axle mounted to the first wheel housing for rotation about a first wheel axis;

wherein the centering spring pivotally urges the first wheel housing, with the first wheel rotatably mounted therein, toward a predetermined first center position for rotational movement in a longitudinal direction of the skate device; and wherein the centering spring may be changed by removing the first spring housing plate from the first spring housing and pivoting the first wheel housing to expose the centering spring.

10. The skate of claim 9 wherein the skate is an in-line skate having an in-line axis and the truck assembly comprises:

a second wheel housing pivotally mounted to the truck plate, wherein the first and second wheel housings are mounted along the in-line axis at opposing end portions of the truck assembly;

a second wheel having a second axle mounted to the second wheel housing for rotation about a second wheel axis;

a second spring housing fixedly attached to the truck plate, the second spring housing having a second spring cavity and a second clearance slot extending laterally therethrough; and a second centering spring mounted within the second spring cavity, the second centering spring being straddle between a second pair of arms extending longitudinally from the second wheel housing through the second clearance slot to pivotally urge the second wheel housing, with the second wheel rotationally mounted therein, toward a predetermined second center position;

wherein the first and second center positions having a relation such that the first and second wheels are substantially aligned along the in-line axis.

11. The skate of claim 10 wherein each wheel housing includes a plurality of longitudinally spaced mounting devices for adjusting the longitudinal distance between the first and second wheel axles along the in-line axis of the skate.

12. The skate of claim 11 wherein the mounting devices include a plurality of longitudinally spaced pairs of mounting holes disposed on axially opposing sides of each wheel housing which are sized to receive each wheel axle therethrough.

13. The skate of claim 9 wherein the spring housing is sized to receive one of a plurality of centering springs, each centering spring having a different spring tension.

14. A skate board comprising:

a board; and a truck assembly for supporting the board and attached to the underside thereof, the truck assembly having, a first spring housing fixedly attached to the board, the first spring housing having a spring cavity, and a spring housing plate removably mounted to one side of the first spring housing, the spring housing having a clearance slot extending laterally therethrough including the spring housing plate, a centering spring removably mounted within the spring cavity and retained therein with the spring housing plate, a first wheel housing pivotally mounted to the board and having a pair of arms extending longitudinally through the clearance slot of the first spring housing to straddle the centering spring therebetween, and a first wheel having a first axle mounted to the first wheel housing for rotation about a first wheel axis;

wherein the centering spring pivotally urges the first wheel housing, with the first wheel rotatably mounted therein, toward a predetermined first center position for rotational movement in a longitudinal direction of the skate device; and wherein the centering spring may be changed by removing the first spring housing plate from the first spring housing and pivoting the first wheel housing to expose the centering spring.

15. The skate board of claim 14 wherein the truck assembly comprises:

a truck plate attached to the board; the first wheel housing pivotally attached to the truck plate; and the first spring housing rigidly attached to the truck plate.

16. The skate board of claim 14 wherein the skate board is an in-line skate board having an in-line axis and the truck assembly comprises:

a second wheel housing pivotally mounted to the board, wherein the first and second wheel housings are mounted along the in-line axis at opposing end portions of the truck assembly;

a second wheel having a second axle mounted to the second wheel housing for rotation about a second wheel axis;

a second spring housing fixedly attached to the board, the second spring housing having a second spring cavity and a second clearance slot extending laterally therethrough; and a second centering spring mounted within the second spring cavity, the second centering spring being straddle between a second pair of arms extending longitudinally from the second wheel housing through the second clearance slot to pivotally urge the second wheel housing, with the second wheel rotationally mounted therein, toward a predetermined second center position;

wherein the first and second center positions having a relation such that the first and second wheels are substantially aligned along the in-line axis.

17. The skate board of claim 16 wherein each wheel housing includes a plurality of longitudinally spaced mounting devices for adjusting the longitudinal distance between the first and second wheel axles along the in-line axis of the skate board.

18. The skate board of claim 17 wherein the mounting devices include a plurality of longitudinally spaced pairs of mounting holes disposed on axially opposing sides of each wheel housing which are sized to receive each wheel axle therethrough.

19. The skate of claim 14 wherein the spring housing is sized to receive one of a plurality of centering springs, each centering spring having a different spring tension.

* * * * *